United States Patent [19]

Kitano

[11] Patent Number: 4,772,883

[45] Date of Patent: Sep. 20, 1988

[54] CRT DISPLAY CONTROL SYSTEM

[75] Inventor: Shigeru Kitano, Nara, Japan

[73] Assignee: Sharp Kabushiki Kaisha, Osaka, Japan

[21] Appl. No.: 59,205

[22] Filed: Jun. 8, 1987

Related U.S. Application Data

[63] Continuation of Ser. No. 694,280, Jan. 24, 1985, abandoned.

[30] Foreign Application Priority Data

Jan. 27, 1984 [JP] Japan ..... 59-13931

[51] Int. Cl.[4] ..... G09G 1/06

[52] U.S. Cl. ..... 340/748; 340/731; 340/735

[58] Field of Search ..... 340/731, 735, 748, 750, 340/790

[56] References Cited

U.S. PATENT DOCUMENTS

| | | | |
|---|---|---|---|
| 3,801,961 | 4/1974 | Coombe | 340/748 |
| 4,323,892 | 4/1982 | Kinghorn | 340/724 |
| 4,342,990 | 8/1982 | Traster | 340/724 |
| 4,426,645 | 1/1984 | Sakai et al. | 340/724 |
| 4,642,622 | 2/1987 | Ito et al. | 340/748 |

*Primary Examiner*—Gerald L. Brigance
*Assistant Examiner*—Jeffery A. Brier
*Attorney, Agent, or Firm*—Birch, Stewart, Kolasch & Birch

[57] ABSTRACT

A CRT display control system controls a character display operation on a CRT image screen. The entire character line height is divided into a display allowed raster section and a display inhibited raster section. The display allowed raster section is provided for displaying characters. The display inhibited raster section functions as a line spacing. When the character matrix size is changed, the display allowed raster section and the display inhibited raster section are modified through the use of a preset system so that the line spacing is easily determined without modifying the circuit construction.

2 Claims, 2 Drawing Sheets

CRT DISPLAY CONTROL SYSTEM

This application is a continuation, of applicaton Ser. No. 694,280 filed on Jan. 24, 1985, now abandoned.

BACKGROUND OF THE INVENTION

1. Field of the Invention

The present invention relates to an improvement in a CRT display control system and, more particularly, to a character display control system in a CRT display system.

2. Description of the Prior Art

There are two types of conventional display control systems which control display of characters of plural rows in a CRT display system. In one conventional type, a dot matrix size assigned to one character, and a line spacing width are fixed. That is, both of the display allowed raster section and the display inhibited raster section are fixed in accordance with the dot matrix size assigned to one character. In this case, the dot matrix size can not be changed without modifying the circuit construction. In another conventional type, the entire row height (including the line spacing) is formed as the display allowed raster section. A character generator ROM stores combined pattern data each of which includes a character pattern data and a line spacing data. Therefore, the character generator ROM must have a considerably large memory capacity because the caracter generator ROM must store the line spacing pattern data in addition to the character pattern data.

OBJECTS AND SUMMARY OF THE INVENTION

OBJECTS OF THE INVENTION

Accordingly, an object of the present invention is to provide a novel control system which is suited for controlling a character display in a CRT display system.

Another object of the present invention is to provide a character display control system wherein a dot matrix size assigned to one character display is changeable.

Other objects and further scope of applicability of the present invention will become apparent from the detailed description given hereinafter. it should be understood, however, that the detailed description and specific examples, while indicating preferred embodiments of the invention, are given by way of illustration only, since various changes and modifications within the spirit and scope of the invention will become apparent to those skilled in the art from this detailed description.

SUMMARY OF THE INVENTION

To achieve the above objects, pursuant to an embodiment of the present invention, the entire row height is divided into a display allowed raster section and a display inhibited raster section. The display allowed raster section is determined in accordance with the dot matrix size of characters to be displayed in a CRT display system. The display inhibited raster section functions as a line spacing. In a preferred form, a preset system is provided which presets the height of each of the display allowed raster section and the display inhibited raster section.

The character display size can be modified, without modifying the circuit construction, by changing the height of the display allowed raster section when the dot matrix size changes. Further, the character generator ROM need not store the line spacing pattern because the line spacing is determined by the height of the display inhibited raster section. Thus, the character memory capacity of the character generator ROM is maximized.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
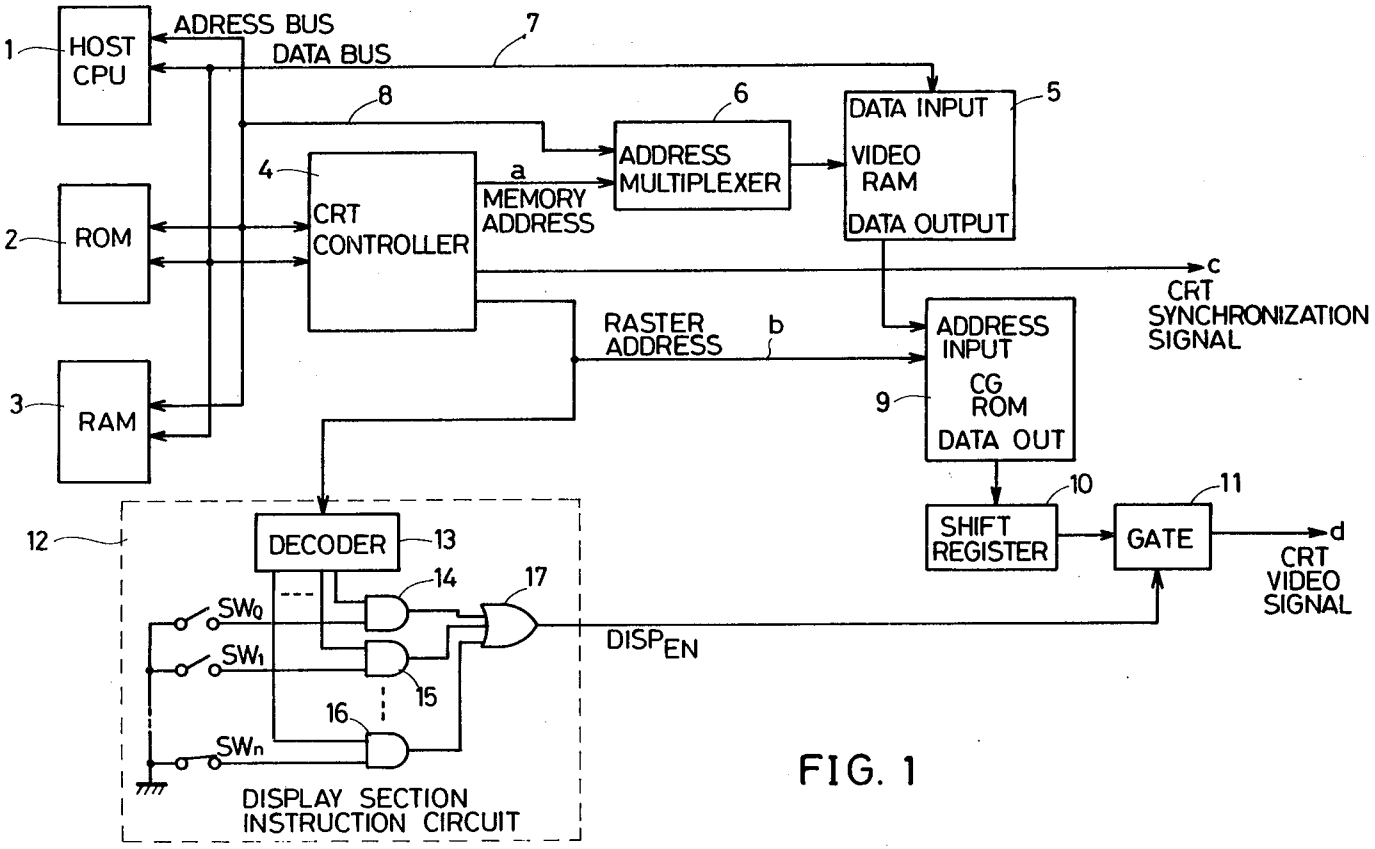
FIG. 1 is a block diagram of an embodiment of a CRT display control system of the present invention.

A CRT display control system of the present invention includes a host central processing unit (HOST CPU) 1, a read only memory (ROM) 2 which stores control program to be applied to the HOST CPU 1, a random access memory (RAM) 3, a CRT controller 4, and a video random access memory (VIDEO RAM) 5. An address multiplexer 6 is associated with the VIDEO RAM 5. The HOST CPU 1, the ROM 2, the RAM 3, the CRT controller 4 and the VIDEO RAM 5 are connected to each other via a data bus 7. Further, the HOST CPU 1, the ROM 2, the RAM 3, the CRT controler 4 and the address multiplexer 6 are connected to each other via an address bus 8.

The HOST CPU 1, the ROM 2, and the RAM 3 function, in combination, to control the total system of the CRT display system. The CRT controller 4 is controlled by the HOST CPU 1, and functions to develop a memory address signal (a) to be applied to the VIDEO RAM 5 via the address multiplexer 6, a raster address signal (b), and a CRT sychronization signal (c) which is applied to the CRT display unit (not shown).

The VIDEO RAM 5 functions as a memory for storing character codes required for the character display operation. The character codes are written into preselected addresses in accordance with the addressing conducted by the HOST CPU 1. the character codes stored in the VIDEO RAM 5 are read out in response to the addressing operation conducted by the CRT controller 4. The character display data for the entire image screen is sequentially read out so as to refresh the CRT display image screen. The switching of the addressing operation from the HOST CPU 1 and the CRT controller 4 is conducted by the address multiplexer 6.

The CRT display control system of the present invention further includes a character generator ROM (CG ROM) 9 which receives the character code data developed from the VIDEO RAM 5 as a primary address signal, and the raster address signal (b) developed from the CRT controller 4 as an auxilliary address signal. An output signal of the CG ROM 9 is developed each time the primary address signal is updated. The output signal of the CG ROM 9 is introduced into a shift register 10 in a parallel fashion. The shift register 10 functions to convert the parallel data into a serial data. The serial data developed from the shift register 10 is applied to a gate circuit 11 the outut signal of which functions as a CRT video signal (d). the CRT video signal (d), and the CRT synchronization signal (c) (including the horizontal synchronization signal and the vertical synchronization signal) are applied to the CRT display unit. When one cycle of the update operation of the primary address signal of the CG ROM 9 is completed, one raster display is completed. Then, the raster address is updated. When one cycle of the update operation of the raster address is completed, one line display is completed. The above-mentioned operaton is repeated to conduct the display of the entire image screen.

Figure 2:
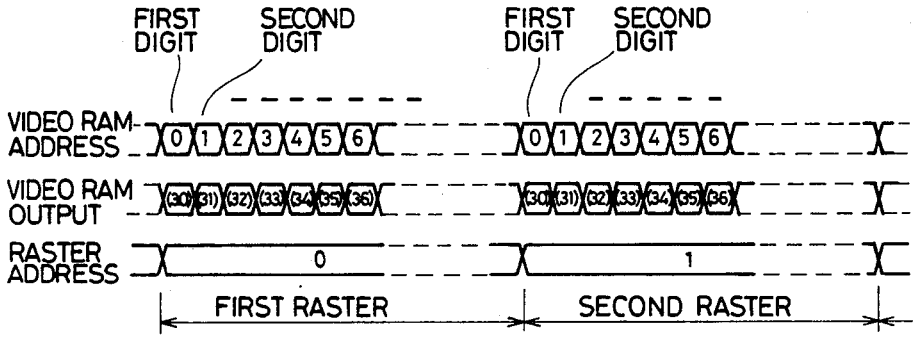
FIG. 2 is a time chart for explaining an operational mode of the CRT display control system of FIG. 1.

FIG. 2 is a time chart showing the VIDEO RAM address signal applied from the address multiplexer 6 to the VIDEO RAM 5, the character code data (functioning as the primary address signal) developed from the VIDEO RAM 5 and applied to the CG ROM 9, and the raster address signal (b) (functioning as the auxiliary address signal) applied to the CG ROM 9 when the display control operation is conducted. The numerals in the parenthesis in FIG. 2 represent the ASCII codes. In this example, the numerals "0, 1, 2, 3, 4, 5, 6 -- - -" are displayed on the line.

Figure 3:
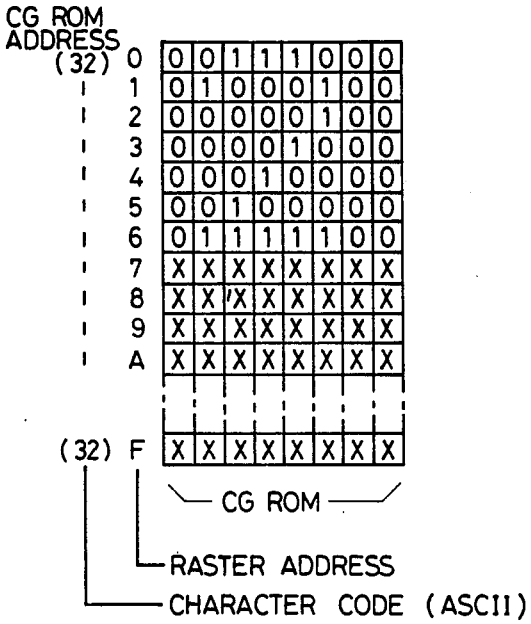
FIG. 3 is a schematic chart for explaining a pattern stored in a character generator ROM included in the CRT display control system of FIG. 1.

FIG. 3 shows an example of the pattern data (for displaying a numeral "2") stored in the CG ROM 9. In FIG. 3, a mark "1" represents a selected dot position, a mark "0" represent a non-selected dot position, and a mark "x" represents an undetermined dot position.

The essential part of the CRT display control system of the present invention is a display section instruction circuit 12, as shown in FIG. 1, which incudes a decoder 13, display section instruction switches $SW_0$ through $SW_n$, AND gates 14, 15, - - -, 16, and an OR gate 17. The display section instruction circuit 12 functions as a multiplexer circuit (including a decoder 13, and gates 14, 15, - - -, 16, and 17 which introduce the switching signals of the display section instruction switches $SW_0$ through $SW_n$ as input signals) which receives the raster address signal (b) developed from the CRT controller 4 as an input signal.

Figure 4:
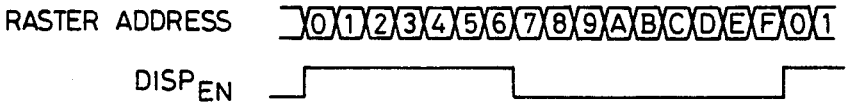
FIG. 4 is a time chart for explaining a control related to a display allowed raster section and a display inhibited raster section in the CRT display control system of FIG. 1.

When the character display is conducted in the dot matrix size as shown in FIG. 3, the display section instruction switches $SW_0$ through $SW_6$ are switched off so as to select the raster addresses 0 through 6 as the displayed allowed raster sections. The AND gates corresponding to the display section instruction switches $SW_0$ through $SW_6$ are placed in the non operative condition. The remaining display section instruction switches $SW_7$ through $SW_F$ are switched on so as to place the corresponding AND gates in the operative condition, thereby selecting the raster addresses 7 through F as the display inhibited raster sections. Under these conditions, a display section instruction output $DISP_{EN}$ developed from the OR gate 17 bears the logic "H" during the raster addresses 0 through 6, and the logic "L" during the raster addresses 7 through F as shown in FIG. 4.

The display section instruction output $DISP_{EN}$ developed from the display section instruction circuit 12 is applied to the CRT display unit via the gate circuit 11. With this construction, for the raster addresses 0 through 6, the character pattern data developed from the CG ROM 9 is applied to the CRT display unit. For the raster addreses 7 through F, the pattern data stored in the CG ROM 9 is not applied to the CRT display unit. That is, the raster addresses 7 through F function as the line spacing. Accordingly, the data stored in these addresses of the CG RO9 does not influence the actual display.

It will be clear from the foregoing decription that the display inhibited raster section is easily determined through the use of the display section instructon switches $SW_0$ through $SW_n$ once the entire line height and the character matrix size are determined. When the character matrix size is changed, the display section instruction switches $SW_0$ through $SW_n$ are operated so that the display allowed raster section corresponds to the character matrix size. since the display inhibited raster secton functions as the line spacing, the CG ROM 9 is not required to store the pattern data for the line spacing. Therefore, the character memory capacity of the CG ROM 9 is maximized.

In the embodiment of FIG. 1, mechanical display section instruction switches $SW_0$ through $SW_n$ are provided. These mechanical switches can be replaced by an output port controlled by the HOST CPU 1, ROM 2 and RAM 3. In this case, the display allowed raster section and the display inhibited raster section can be preset when, for example, the character dot matrix size information is introduced through a key board panel associated with the CRT display system.

The invention being thus described, it will be obvious that the same may be varied in many ways. Such variation are not to be regarded as a departure from the spirit and scope of the invention, and all such modifications are intended to be included within the scope of the following claims.

What is claimed is:

1. A CRT display control system for displaying characters on a CRT display unit, comprising:

character storage means for storing data representative of characters of predetermined matrix height to be displayed on said display unit within a horizontal character line composed of a predetermined number of raster lines;

display secton determination means for selectively dividing said horiztonal character line into a horizontal display allowed raster seciton and a horizontal display inhibited raster section, including, means for varying the number of raster lines in said display allowed raster section to enable the display of characters of various matrix height, data from said character storage means being applied only to said display allowed raster section, said display inhibited raster section forming line spacing between characters.

2. The CRT display control system of claim 1, wherein said character storage means includes a character generator ROM which stores a character matrix pattern of a height corresponding to the number of raster lines in said display allowed raster section.

* * * * *